US009516405B2

(12) United States Patent
Yeh et al.

(10) Patent No.: US 9,516,405 B2
(45) Date of Patent: Dec. 6, 2016

(54) MULTIMEDIA PLAYING SYSTEM AND SOUND CHANNEL CONTROL METHOD THEREOF

(71) Applicant: Acer Incorporated, New Taipei (TW)

(72) Inventors: Neng-Wen Yeh, New Taipei (TW); Chiang-Tsun Chen, New Taipei (TW); Chien-Hung Li, New Taipei (TW); Po-Jen Tu, New Taipei (TW); Chun-Chieh Chiu, New Taipei (TW); Sheng-Yu Weng, New Taipei (TW); Tzu-Hsiang Chang, New Taipei (TW); Iou-Ren Su, New Taipei (TW)

(73) Assignee: ACER INCORPORATED, New Taipei (TW)

( * ) Notice: Subject to any disclaimer, the term of this patent is extended or adjusted under 35 U.S.C. 154(b) by 87 days.

(21) Appl. No.: 14/656,969

(22) Filed: Mar. 13, 2015

(65) Prior Publication Data

US 2015/0326990 A1 Nov. 12, 2015

(30) Foreign Application Priority Data

May 6, 2014 (TW) ..... 103116043 A

(51) Int. Cl.
*H04R 5/033* (2006.01)
*H04R 1/10* (2006.01)
(Continued)

(52) U.S. Cl.
CPC ..... *H04R 1/1041* (2013.01); *H04R 5/033* (2013.01); *H04R 5/04* (2013.01); *H04S 7/308* (2013.01);
(Continued)

(58) Field of Classification Search
CPC ..... H04R 1/1041; H04R 5/033
(Continued)

(56) References Cited

U.S. PATENT DOCUMENTS 9,367,218 B2 6/2016 Chien et al.
2009/0046869 A1* 2/2009 Griffin, Jr. ..... H04R 5/033 381/74
(Continued)

FOREIGN PATENT DOCUMENTS

CN 203279123 11/2013
TW 201202892 1/2012
(Continued)

*Primary Examiner* — Paul S Kim
*Assistant Examiner* — Katherine Faley
(74) *Attorney, Agent, or Firm* — McClure, Qualey & Rodack, LLP

(57) ABSTRACT

A multimedia playing system is provided. A portable electronic device includes a first dock port, a second dock port, a power module, an audio processor and a controller. When a first single-ear wireless earphone connects with the first dock port, the power module charges the first single-ear wireless earphone via the first dock port. When a second single-ear wireless earphone connects with the second dock port, the power module charges the second single-ear wireless earphone via the second dock port. The audio processor provides a left sound channel signal and a right sound channel signal. When the first single-ear wireless earphone separates from the first dock port, the controller provides one of the left sound channel signal and the right sound channel signal to the first single-ear wireless earphone according to a relative position between the first dock port and a user.

20 Claims, 6 Drawing Sheets

(51) Int. Cl.
*H04S 7/00* (2006.01)
*H04R 5/04* (2006.01)

(52) U.S. Cl.
CPC ..... *H04R 2205/021* (2013.01); *H04R 2420/01* (2013.01); *H04R 2420/07* (2013.01)

(58) Field of Classification Search
USPC ..... 381/309, 311, 74
See application file for complete search history.

(56) References Cited

U.S. PATENT DOCUMENTS

2014/0079238 A1* 3/2014 Bastide ..... H04R 5/033 381/74
2014/0086438 A1* 3/2014 Tachibana ..... H04R 29/001 381/309

FOREIGN PATENT DOCUMENTS

TW 201242356 10/2012
TW M441984 11/2012

* cited by examiner

MULTIMEDIA PLAYING SYSTEM AND SOUND CHANNEL CONTROL METHOD THEREOF

CROSS REFERENCE TO RELATED APPLICATIONS

This Application claims priority of Taiwan Patent Application No. 103116043, filed on May 6, 2014, the entirety of which is incorporated by reference herein.

BACKGROUND OF THE INVENTION

1. Field of the Invention

The invention relates to a multimedia playing system, and more particularly to a multimedia playing system capable of automatically selecting the sound channels.

2. Description of the Related Art

Nowadays, the sizes of portable electronic devices are getting smaller, and more and more functions can be provided. Because of their convenience, users prefer to use the portable electronic devices to listen to music and watch videos. In general, when playing the multimedia applications, a user will use the built-in speaker of the portable electronic device or wear earphones to listen to the sound played by the applications.

Currently, in the design of earphone devices, the left and right sound channels are designed on the same device, in order to achieve a stereo effect. The user needs to identify which is the left/right sound channel earphone through the text (L/R) on the earphone devices, or by color.

Therefore, a multimedia playing system with an automatic channel selection function is desired, such that the user can directly wear the earphones without manually identifying the sound channels of the earphones.

BRIEF SUMMARY OF THE INVENTION

A multimedia playing system and a sound channel control method thereof are provided. An embodiment of a multimedia playing system is provided. The multimedia playing system comprises a first single-ear type wireless earphone, a second single-ear type wireless earphone, and a portable electronic device. The portable electronic device comprises a first dock port, a second dock port, a power module, an audio processor and a controller. The power module charges the first single-ear type wireless earphone via the first dock port when the first single-ear type wireless earphone connects with the first dock port of the portable electronic device, and charges the second single-ear type wireless earphone via the second dock port when the second single-ear type wireless earphone connects with the second dock port of the portable electronic device. The audio processor provides a left sound channel signal and a right sound channel signal. The controller provides one of the left sound channel signal and the right sound channel signal to the first single-ear type wireless earphone according to a first relative position between the first dock port and a user when the first single-ear type wireless earphone separates from the first dock port.

Furthermore, an embodiment of a sound channel control method for a multimedia playing system is provided, wherein the multimedia playing system comprises a portable electronic device, a first single-ear type wireless earphone and a second single-ear type wireless earphone. The first single-ear type wireless earphone is charged via a first dock port of the portable electronic device when the first single-ear type wireless earphone is connected to the first dock port of the portable electronic device. The second single-ear type wireless earphone is charged via a second dock port of the portable electronic device when the second single-ear type wireless earphone is connected to the second dock port of the portable electronic device. A first relative position between the first dock port and a user is obtained when detecting that the first single-ear type wireless earphone separates from the first dock port. The left sound channel signal or the right sound channel signal is provided to the first single-ear type wireless earphone according to the first relative position.

A detailed description is given in the following embodiments with reference to the accompanying drawings.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
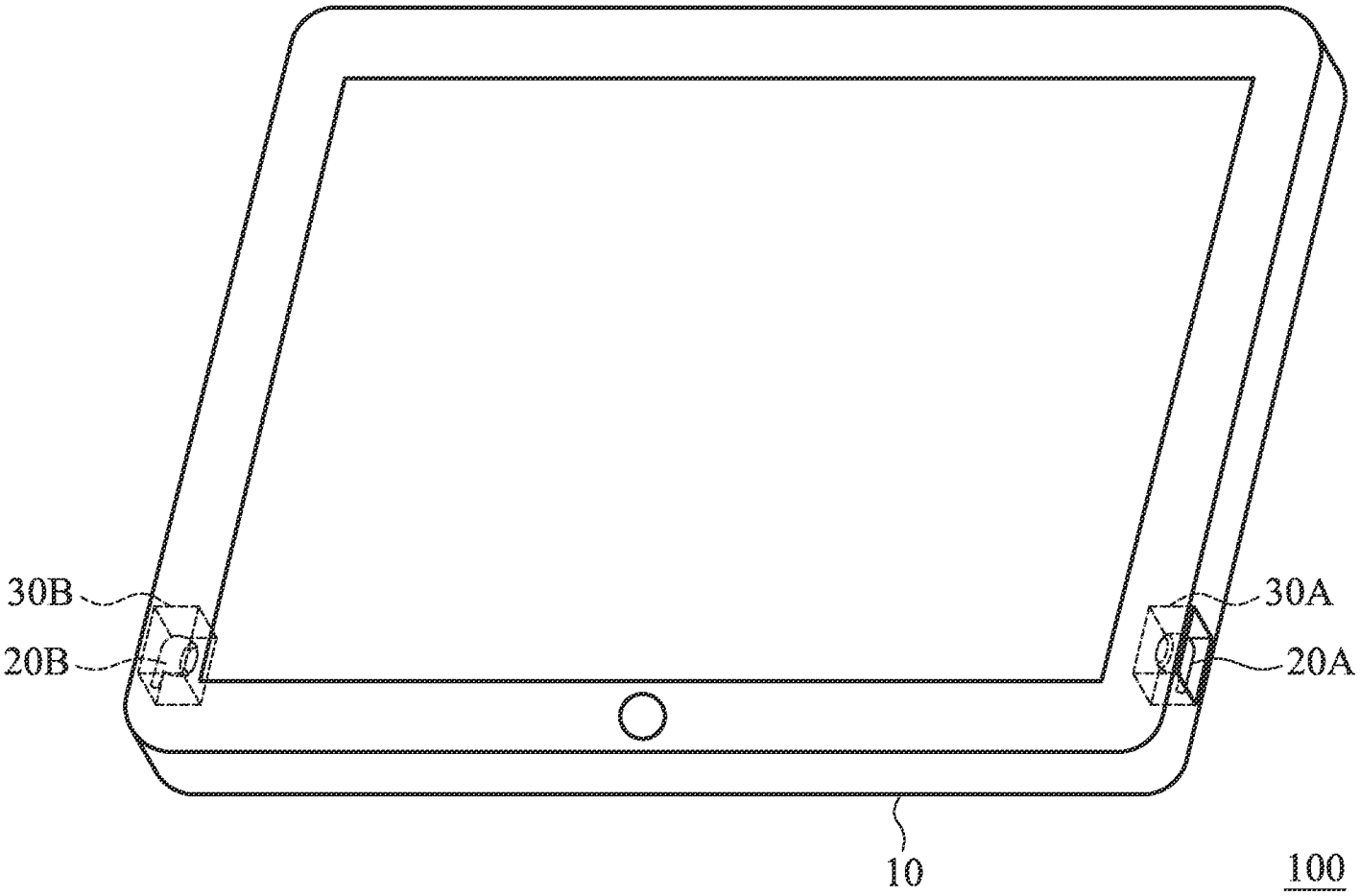
FIG. 1 shows a multimedia playing system 100 according to an embodiment of the invention.

FIG. 1 shows a multimedia playing system 100 according to an embodiment of the invention. The multimedia playing system 100 comprises a portable electronic device 10 and a pair of single-ear type wireless earphones 20A and 20B. The portable electronic device 10 has the dock ports 30A and 30B for connecting the single-ear type wireless earphones 20A and 20B, respectively. In the embodiment, when any single-ear type wireless earphone connects to the dock port 30A/30B of the portable electronic device 10, the portable electronic device 10 can charge the connected single-ear type wireless earphone via the dock port 30A/30B. When the single-ear type wireless earphones 20A and 20B separate from the dock port 30A and 30B, i.e. the user pulls out the single-ear type wireless earphones 20A and 20B from the dock ports 30A and 30B, the portable electronic device 10 can automatically provide a left sound channel signal and a right sound channel signal to the corresponding single-ear type wireless earphones 20A and 20B according to the relative position between the user and the dock ports 30A and 30B. Specifically, when the single-ear type wireless earphone separates from the connected dock port, the single-ear type wireless earphone will receive a stereo signal, the left sound channel signal or the right sound channel signal from the portable electronic device 10 for playback, wherein the portable electronic device 10 can automatically provide the corresponding sound channel signal or the stereo signal to the single-ear type wireless earphone according to the relative position between the dock port and the user. In the embodiment, the portable electronic device 10 is a tablet PC. In the embodiment, the dock ports 30A and 30B are disposed on the opposite sides of the portable electronic device 10. In another embodiment, the dock ports 30A and 30B can be disposed on the same side of the portable electronic device 10.

Figure 2:
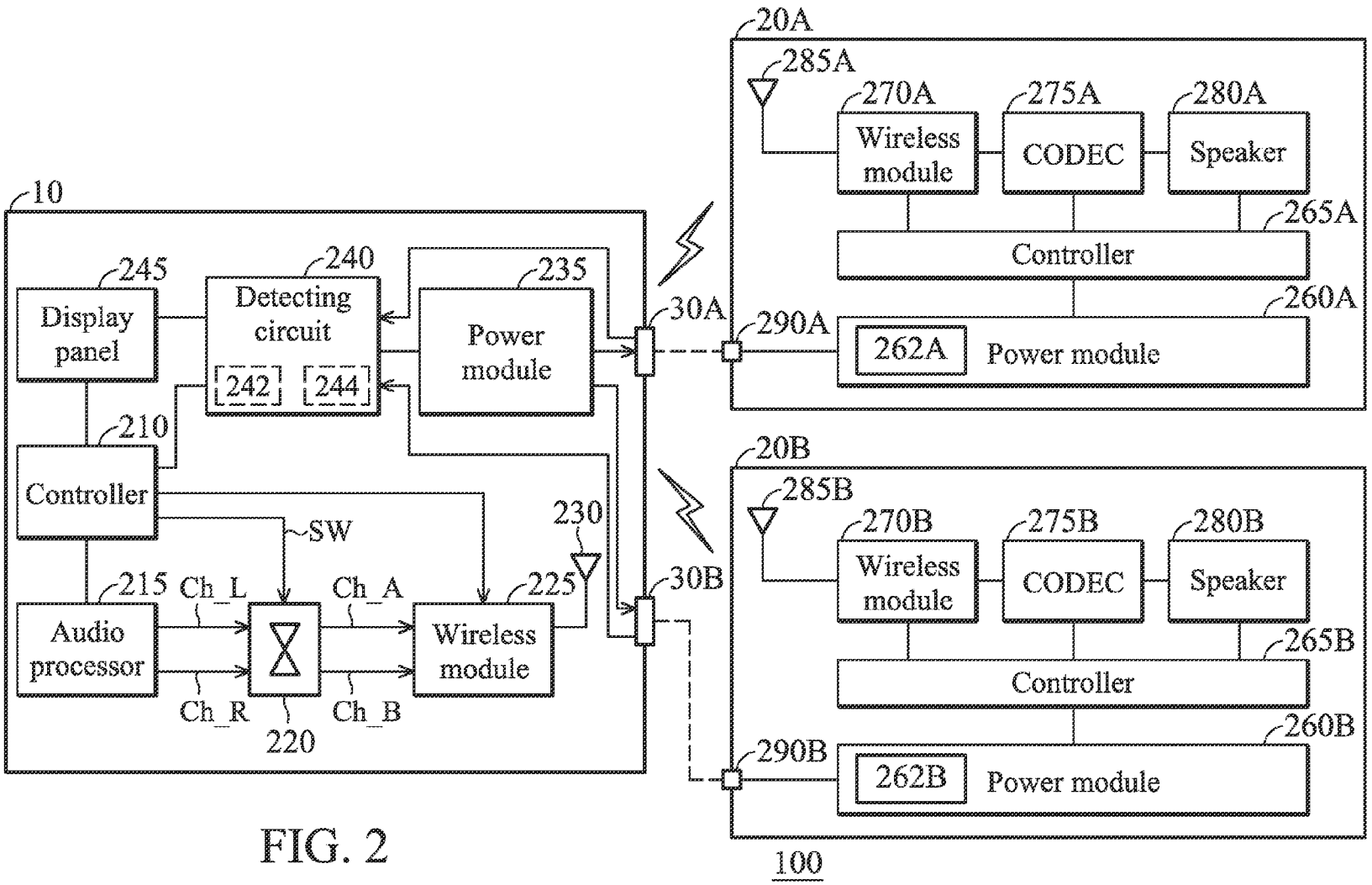
FIG. 2 shows a circuit diagram of the multimedia playing system of FIG. 1.

FIG. 2 shows a circuit diagram of the multimedia playing system 100 of FIG. 1. The multimedia playing system 100 comprises the portable electronic device 10 and the single-ear type wireless earphones 20A and 20B. The portable electronic device 10 comprises a controller 210, an audio processor 215, an audio switch 220, a wireless module 225, an antenna 230, a power module 235, a detecting circuit 240, a display panel 245, and the dock ports 30A and 30B. The detecting circuit 240 is coupled to the dock port 30A and the dock port 30B, and the detecting circuit 240 is capable of detecting whether the single-ear type wireless earphone connects to or separates from the dock port 30A or the dock port 30B, and then subsequent operations will be performed. For example, if the detecting circuit 240 detects that the single-ear type wireless earphone 20A is coupled to the dock port 30A via a connection port 290A, the detecting circuit 240 controls the power module 235 charges the single-ear type wireless earphone 20A via the dock port 30A. Similarly, when the detecting circuit 240 detects that the single-ear type wireless earphone 20B is coupled to the dock port 30B via the connection port 290B, the detecting circuit 240 controls the power module 235 to charge the single-ear type wireless earphone 20B via the dock port 30B. Furthermore, when the detecting circuit 240 detects that the single-ear type wireless earphone 20A separates from the dock port 30A (i.e. the single-ear type wireless earphone 20A is not coupled to the dock port 30A) or the single-ear type wireless earphone 20B separates from the dock port 30B (i.e. the single-ear type wireless earphone 20B is not coupled to the dock port 30B), the detecting circuit 240 further detects a relative position DU between the dock port 30A, the dock port 30B and the user, and notifies the controller 210 of the relative position DU. Next, according to the relative position DU, the controller 210 determines which one of the dock ports 30A or 30B, is located on the left side of the user and which one is located on the right side of the user. The dock port located on the left side of the user is assigned to a left sound channel port by the controller 210, and the single-ear type wireless earphone separated from the left sound channel port is assigned to a left sound channel earphone by the controller 210. Furthermore, the dock port located on the right side of the user is assigned to a right sound channel port by the controller 210, and the single-ear type wireless earphone separated from the right sound channel port is assigned to a right sound channel earphone by the controller 210.

Figure 3A:
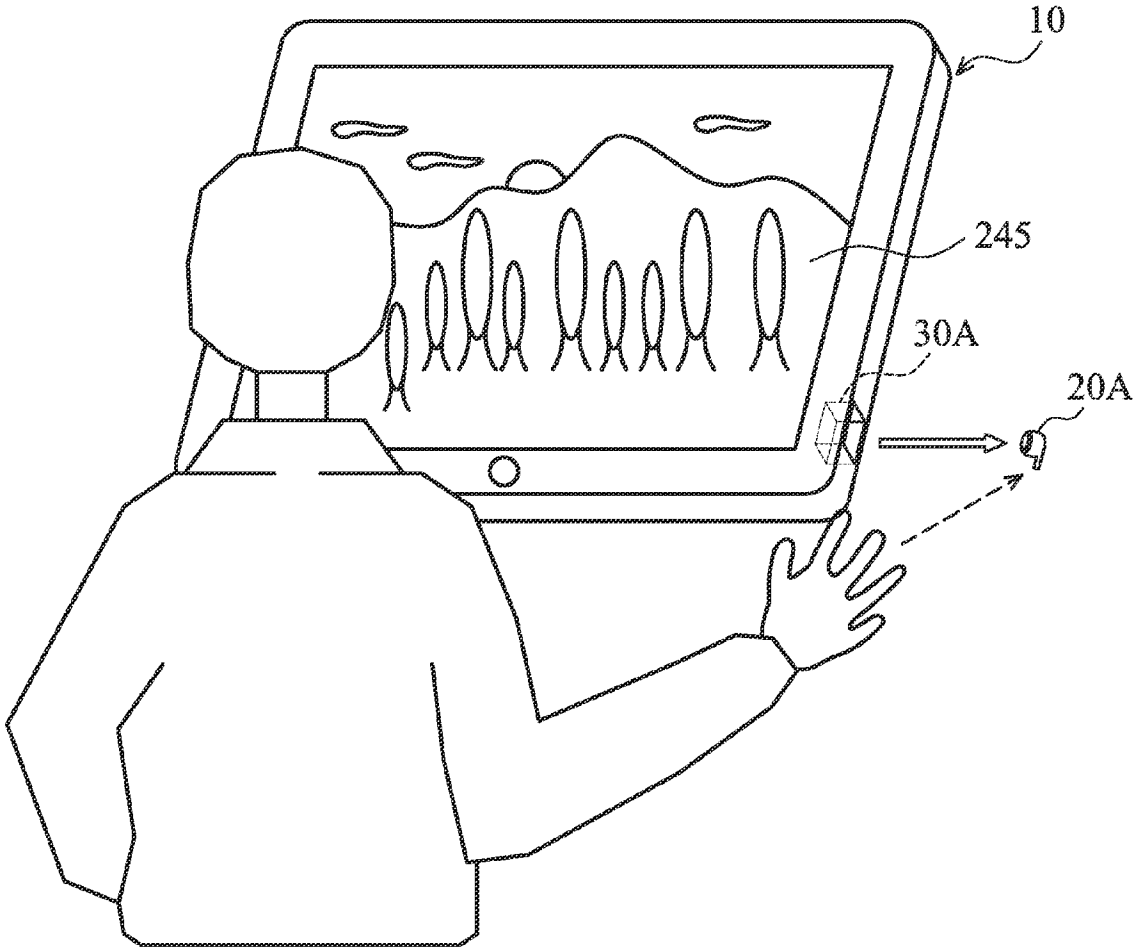
FIG. 3A shows a schematic illustrating how the single-ear type wireless earphone is pulled out from the portable electronic device according to an embodiment of the invention.
Figure 3B:
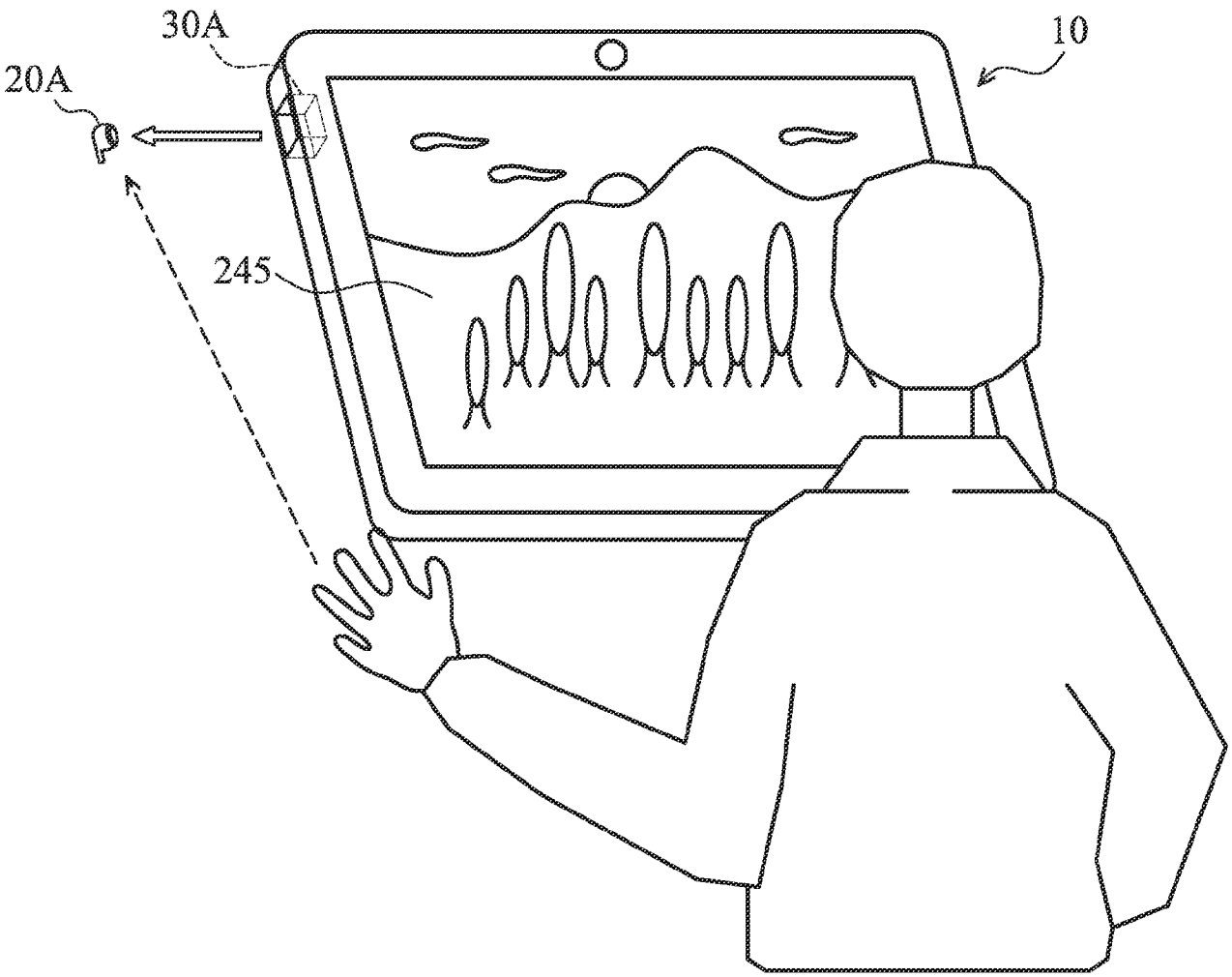
FIG. 3B shows a schematic illustrating how the single-ear type wireless earphone is pulled out from the portable electronic device according to another embodiment of the invention.

For example, in the portable electronic device 10, the detecting circuit 240 obtains the relative position DU between the dock port 30A and the user according to a display picture displayed in the display panel 245 by a multimedia application being run, and obtains a relative position DD between the display panel 245 and the dock port 30A, so as to determine whether the single-ear type wireless earphone 20A is a left sound channel earphone or a right sound channel earphone. Referring to FIG. 3A and FIG. 3B, FIG. 3A shows a schematic illustrating how the single-ear type wireless earphone 20A is pulled out from the portable electronic device 10 according to an embodiment of the invention, and FIG. 3B shows a schematic illustrating how the single-ear type wireless earphone 20A is pulled out from the portable electronic device 10 according to another embodiment of the invention. In FIG. 3A, according to the display picture displayed in the display panel and the relative position DD between the display panel 245 and the dock port 30A (i.e. the dock port 30A is located in the lower right of the display panel 245), the portable electronic device 10 determines that the dock port 30A is located on the right side of the user. In FIG. 3B, according to the display picture displayed in the display panel and the relative position DD between the display panel 245 and the dock port 30A (i.e. the dock port 30A is located on the upper left of the display panel 245), the portable electronic device 10 determines that the dock port 30A is located on the left side of the user. Furthermore, in one embodiment, the detecting circuit 240 further comprises a sensor 242. The sensor 242 is a gravity sensor, a gyroscope, or an electronic compass (E-Compass), which is used to obtain an inclination angle of the portable electronic device 10. Thus, the detecting circuit 240 can obtain the relative position DU between the dock port 30A and the user according to the inclination angle. In another embodiment, the detecting circuit 240 further comprises an image capturing device 244, which is used to obtain an image of the user's face. Thus, the detecting circuit 240 can obtain the relative position DU between the dock port 30A and the user according to the image of the user's face.

In FIG. 2, when the single-ear type wireless earphone 20A is coupled to the dock port 30A and the single-ear type wireless earphone 20B is coupled to the dock port 30B, the controller 210 controls the wireless module 225 to enter a sleep mode. Moreover, when detecting that the single-ear type wireless earphone 20A separates from the dock port 30A or the single-ear type wireless earphone 20B separates from the dock port 30B, the detecting circuit 240 notifies the controller 210 to determine whether the wireless module 225 is enabled. If the wireless module 225 is disabled, the controller 210 will enable the wireless module 225, so that the portable electronic device 10 can communicate with the separated single-ear type wireless earphone via the wireless module 225. Thus, the controller 210 obtains an identification (ID) code of the single-ear type wireless earphone via the wireless module 225. Specifically, when any single-ear type wireless earphone departs from the connected dock port, the controller 210 can determine that the single-ear type wireless earphone is separated from the dock port 30A or the dock port 30B, and the controller 210 can determine that the single-ear type wireless earphone is the single-ear type wireless earphone 20A or 20B through a wireless connection. Simultaneously, the controller 210 determines that the single-ear type wireless earphone is a left sound channel earphone or a right sound channel earphone, and provides a sound channel switching signal SW to the audio switch 220. In FIG. 2, according to the multimedia application being performed, the controller 210 controls the audio processor 215 to generate a left sound channel signal Ch_L and a right sound channel signal Ch_R, and transmits the left sound channel signal Ch_L and the right sound channel signal Ch_R to the audio switch 220. Next, the controller 210 switches the left sound channel signal Ch_L and the right sound channel signal Ch_R according to the sound channel switching signal SW, to generate an audio signal Ch_A to be transmitted to the single-ear type wireless earphone 20A and an audio signal Ch_B to be transmitted to the single-ear type wireless earphone 20B. For example, when determining that the single-ear type wireless earphone 20A is a left sound channel earphone and the single-ear type wireless earphone 20B is a right sound channel earphone, the controller 210 provides the sound channel switching signal SW to the audio switch 220, so as to control the audio switch 220 to operate in a normal mode. Thus, the audio switch 220 assigns the left sound channel signal Ch_L to the audio signal Ch_A, and assigns the right sound channel signal Ch_R to the audio signal Ch_B. Conversely, when determining that the single-ear type wireless earphone 20A is a right sound channel earphone and the single-ear type wireless earphone 20B is a left sound channel earphone, the controller 210 provides the sound channel switching signal SW to the audio switch 220, so as to control the audio switch 220 to operate in a reverse mode. Thus, the audio switch 220 assigns the left sound channel signal Ch_L to the audio signal Ch_B, and assigns the right sound channel signal Ch_R to the audio signal Ch_A. Furthermore, after receiving the audio signal Ch_A and the audio signal Ch_B, the wireless module 225 transmits the audio signals Ch_A and Ch_B to the single-ear type wireless earphones 20A and 20B via the antenna 230. In one embodiment, if only one single-ear type wireless earphone is pulled out from the portable electronic device 10, the portable electronic device 10 provides a stereo signal formed by the audio signals Ch_A and Ch_B to the single-ear type wireless earphone for playback.

In FIG. 2, the single-ear type wireless earphone 20A comprises a power module 260A, a controller 265A, a wireless module 270A, a CODEC 275A, a speaker 280A, and an antenna 285A. The single-ear type wireless earphone 20B comprises a power module 260B, a controller 265B, a wireless module 270B, a CODEC 275B, a speaker 280B and an antenna 285B. In the embodiment, the single-ear type wireless earphone 20A and the single-ear type wireless earphone 20B have the same circuits and the same appearance, and each has an individual ID code. In the embodiment, the single-ear type wireless earphone 20A has a ID code ID_A, and the single-ear type wireless earphone 20B has a ID code ID_B. Taking the single-ear type wireless earphone 20A as an example, when the single-ear type wireless earphone 20A connects with the dock port 30A via the connection port 290A, the power module 235 of the portable electronic device 10 can charge a battery 262A of the power module 260A of the single-ear type wireless earphone 20A via the dock port 30A and the connection port 290A. When the single-ear type wireless earphone 20A separates from the dock port 30A, the power module 235 stops charging the battery 262A of the power module 260A. Next, in the single-ear type wireless earphone 20A, the controller 265A enables the wireless module 270A, so as to communicate with the wireless module 225 of the portable electronic device 10 via the antenna 285A, and provides its ID code ID_A to the portable electronic device 10. As described above, when the single-ear type wireless earphone 20A separates from the dock port 30A of the portable electronic device 10, the detecting circuit 240 of the portable electronic device 10 will determine that the dock port 30A is located on the right side or the left side of the user. If the dock port 30A is located on the right side of the user, the portable electronic device 10 determines that the dock port 30A is a right sound channel connection port, and controls the audio switch 220 to operate in the reverse mode, so as to assign the right sound channel signal Ch_R to the audio signal Ch_A, and then transmits the audio signal Ch_A to the single-ear type wireless earphone 20A via the wireless module 225. Thus, after the single-ear type wireless earphone 20A receives the data packets comprising the audio signal Ch_A via the antenna 285A and the wireless module 270A, the single-ear type wireless earphone 20A will decode the received data packets via the CODEC 275A to obtain the right sound channel signal Ch_R, and play the right sound channel signal Ch_R via the speaker 280A. Conversely, if the dock port 30A is located on the left side of the user, the portable electronic device 10 will determine that the dock port 30A is a left sound channel connection port, and control the audio switch 220 to operate in the normal mode, to assign the left sound channel signal Ch_L to the audio signal Ch_A, and transmits the audio signal Ch_A to the single-ear type wireless earphone 20A via the wireless module 225. Thus, when the single-ear type wireless earphone 20A receives the data packets comprising the audio signal Ch_A via the antenna 285A and the wireless module 270A, the CODEC 275A decodes the received data packets to obtain the left sound channel signal Ch_L, and plays the left sound channel signal Ch_L via the speaker 280A.

Figure 4:
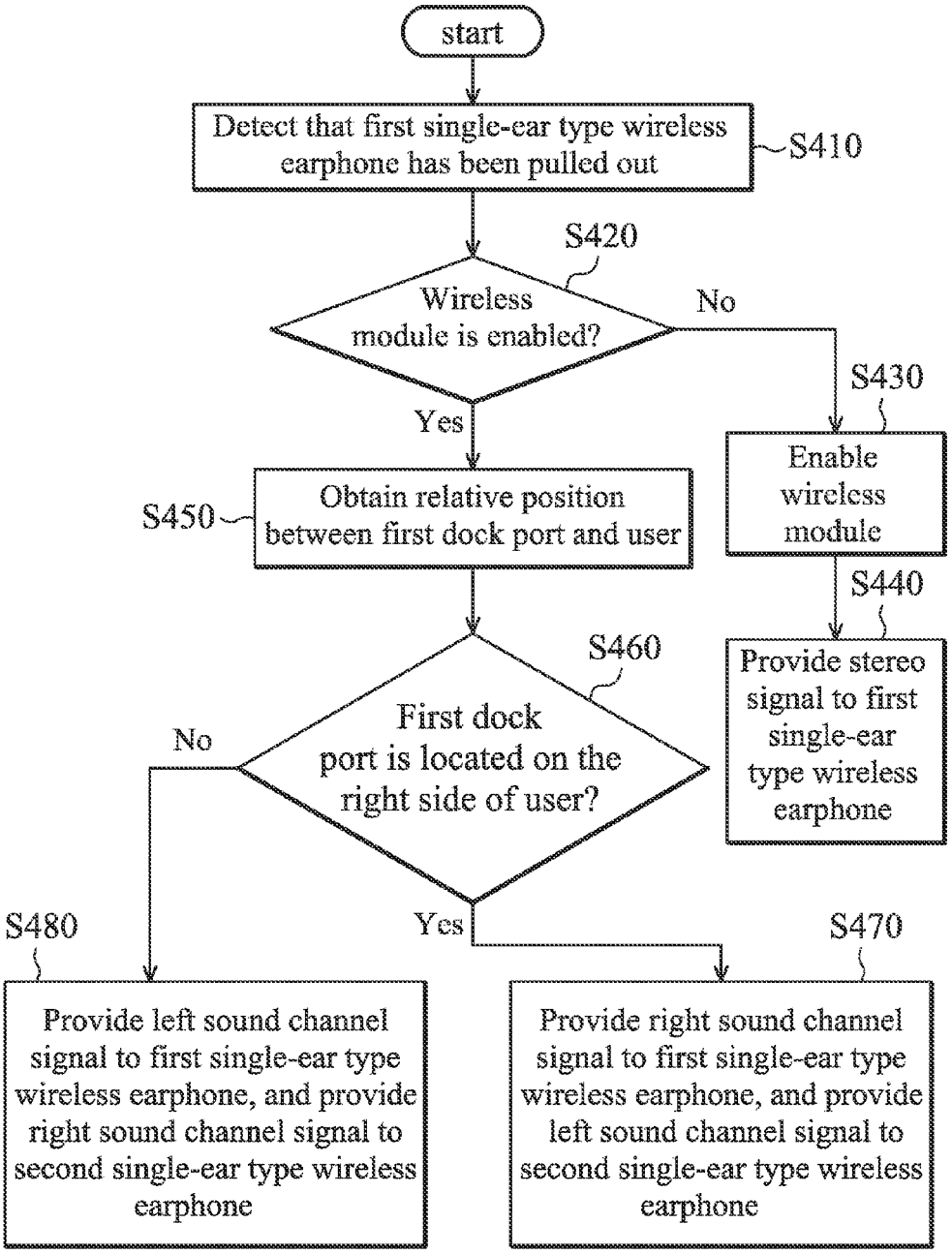
FIG. 4 shows a sound channel control method according to an embodiment of the invention.

FIG. 4 shows a sound channel control method according to an embodiment of the invention. Referring to FIG. 1 and FIG. 4 together, first, in step S410, the portable electronic device 10 detects that a first single-ear type wireless earphone (e.g. 20A or 20B) has been pulled out by the user, i.e. the first single-ear type wireless earphone separates from the first dock port. Next, in step S420, it is determined whether the wireless module of the portable electronic device 10 is enabled. If the wireless module is disabled (i.e. in a sleep mode), the wireless module of the portable electronic device 10 is enabled (step S430). Next, in step S440, the portable electronic device 10 provides the stereo signal to the first single-ear type wireless earphone via the wireless module, wherein the stereo signal is formed by the left sound channel signal and the right sound channel signal. Conversely, if the wireless module is enabled (i.e. the second single-ear type wireless earphone has be pulled out), the relative position DU between the first dock port and the user is obtained (step S450). Next, in step S460, according to the relative position DU, the portable electronic device 10 determines whether the first dock port is located on the right side of the user. If yes, the right sound channel signal is provided to the first single-ear type wireless earphone, and the left sound channel signal is provided to a second single-ear type wireless earphone (step S470). Conversely, if the first dock port is located on the left side of the user, the left sound channel signal is provided to the first single-ear type wireless earphone, and the right sound channel signal is provided to the second single-ear type wireless earphone (step S480).

Figure 5:
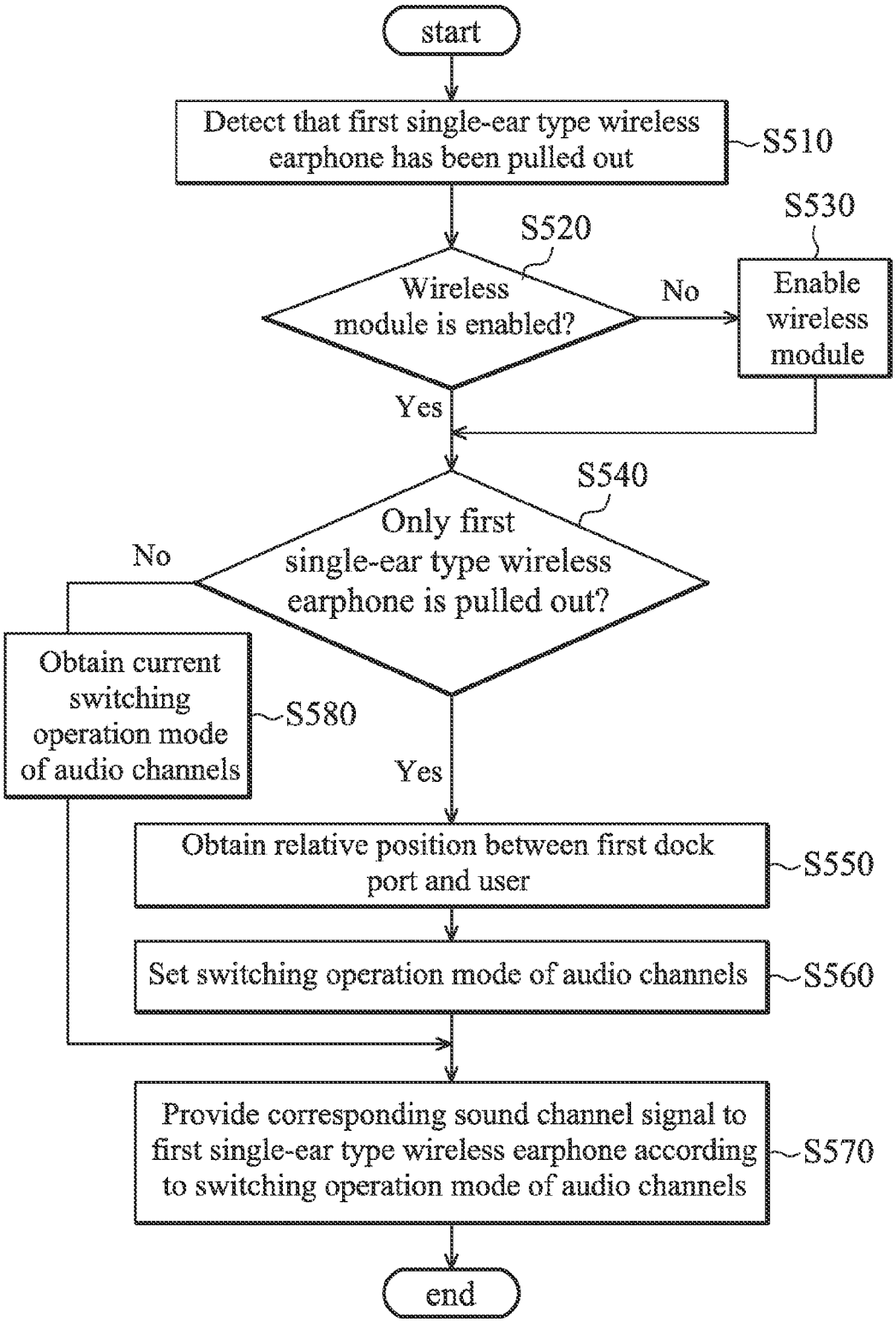
FIG. 5 shows a sound channel control method according to another embodiment of the invention.

FIG. 5 shows a sound channel control method according to another embodiment of the invention. Referring to FIG. 1 and FIG. 5 together, first, in step S510, the portable electronic device 10 detects that a first single-ear type wireless earphone (e.g. 20A or 20B) is pulled out by the user, i.e. the first single-ear type wireless earphone separates from the first dock port. Next, in step S520, it is determined whether the wireless module of the portable electronic device 10 is enabled. If the wireless module is enabled, the portable electronic device 10 determines whether only the first single-ear type wireless earphone is pulled out (step S540). Conversely, if the wireless module is disabled (i.e. the sleep mode), the wireless module of the portable electronic device 10 is enabled (step S530), and then it is determined whether only the first single-ear type wireless earphone is pulled out (step S540). If only the first single-ear type wireless earphone is pulled out by the user, the relative position DU between the first dock port and the user is obtained (step S550). Next, in step S560, according to the relative position DU, the portable electronic device 10 sets the switching operation mode of the audio channels. Next, in step S570, the portable electronic device 10 provides the corresponding sound channel signal to the first single-ear type wireless earphone according to the switching operation mode of the audio channels. Conversely, if the second single-ear type wireless earphone has been pulled out, the portable electronic device 10 obtains the current switching operation mode of the audio channels (step S580). Next, the portable electronic device 10 provides the corresponding sound channel signal to the first single-ear type wireless earphone according to the switching operation mode of the audio channels (step S570). Furthermore, the portable electronic device 10 also provides another sound channel signal to the second single-ear type wireless earphone according to the switching operation mode of the audio channels. Since the single-ear type wireless earphone that is the first earphone separating from the dock port will determine that the switching operation mode of the audio channels is the normal or reverse mode, the single-ear type wireless earphone that is the second earphone separating from the dock port will not change the switching operation mode of the audio channels. As described above, when the audio switch 220 of FIG. 2 is operating in the normal mode, the left sound channel signal Ch_L is assigned to the audio signal Ch_A, and the right sound channel signal Ch_R is assigned to the audio signal Ch_B. Furthermore, when the audio switch 220 of FIG. 2 is operating in the reverse mode, the left sound channel signal Ch_L is assigned to the audio signal Ch_B, and the right sound channel signal Ch_R is assigned to the audio signal Ch_A.

While the invention has been described by way of example and in terms of the preferred embodiments, it is to be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A multimedia playing system, comprising:

a first single-ear type wireless earphone;

a second single-ear type wireless earphone; and a portable electronic device, comprising:

a first dock port;

a second dock port;

a power module, charging the first single-ear type wireless earphone via the first dock port when the first single-ear type wireless earphone connects with the first dock port of the portable electronic device, and charging the second single-ear type wireless earphone via the second dock port when the second single-ear type wireless earphone connects with the second dock port of the portable electronic device;

an audio processor, providing a left sound channel signal and a right sound channel signal; and a controller, providing one of the left sound channel signal and the right sound channel signal to the first single-ear type wireless earphone according to a first relative position between the first dock port and a user when the first single-ear type wireless earphone separates from the first dock port.

2. The multimedia playing system as claimed in claim 1, wherein the portable electronic device further comprises:

a wireless module;

a display panel; and a detecting circuit, detecting whether the first single-ear type wireless earphone separates from the first dock port, and obtaining the first relative position between the first dock port and the user when the first single-ear type wireless earphone separates from the first dock port, wherein when the first relative position represents that the first dock port is located on the right side of the user, the controller provides the right sound channel signal to the first single-ear type wireless earphone via the wireless module, and when the first relative position represents that the first dock port is located on the left side of the user, the controller provides the left sound channel signal to the first single-ear type wireless earphone via the wireless module.

3. The multimedia playing system as claimed in claim 2, wherein the detecting circuit obtains the first relative position between the first dock port and the user according to a display picture displayed in the display panel by a multimedia application and a second relative position between the display panel and the first dock port.

4. The multimedia playing system as claimed in claim 2, wherein the detecting circuit further comprises:

a gravity sensor, a gyroscope, or an electronic compass, obtaining an inclination angle of the portable electronic device, wherein the detecting circuit obtains the first relative position between the first dock port and the user according to the inclination angle.

5. The multimedia playing system as claimed in claim 2, wherein the detecting circuit further comprises:

an image capturing device, obtaining a face image of the user, wherein the detecting circuit obtains the first relative position between the first dock port and the user according to the face image.

6. The multimedia playing system as claimed in claim 1, wherein when the first single-ear type wireless earphone and the second single-ear type wireless earphone are respectively coupled to the first dock port and the second dock port of the portable electronic device, the wireless module of the portable electronic device enters a sleep mode.

7. The multimedia playing system as claimed in claim 1, wherein when the second single-ear type wireless earphone separates from the second dock port, the controller provides the other of the left sound channel signal and the right sound channel signal to the second single-ear type wireless earphone.

8. The multimedia playing system as claimed in claim 1, wherein the portable electronic device is a tablet PC.

9. The multimedia playing system as claimed in claim 1, wherein before the first single-ear type wireless earphone separates from the first dock port, the second single-ear type wireless earphone has separated from the second dock port, and before the first single-ear type wireless earphone separates from the first dock port, the controller provides a stereo signal to the second single-ear type wireless earphone, wherein the stereo signal comprises the left sound channel signal and the right sound channel signal.

10. The multimedia playing system as claimed in claim 9, wherein after the first single-ear type wireless earphone separates from the first dock port, the controller stops providing the stereo signal to the second single-ear type wireless earphone, and provides the other of the left sound channel signal and the right sound channel signal to the second single-ear type wireless earphone.

11. A sound channel control method for a multimedia playing system, wherein the multimedia playing system comprises a portable electronic device, a first single-ear type wireless earphone and a second single-ear type wireless earphone, the sound channel control method comprising:

charging the first single-ear type wireless earphone via a first dock port of the portable electronic device when the first single-ear type wireless earphone is connected to the first dock port of the portable electronic device;

charging the second single-ear type wireless earphone via a second dock port of the portable electronic device when the second single-ear type wireless earphone is connected to the second dock port of the portable electronic device;

obtaining a first relative position between the first dock port and a user when detecting that the first single-ear type wireless earphone separates from the first dock port; and providing one of a left sound channel signal and a right sound channel signal to the first single-ear type wireless earphone according to the first relative position.

12. The sound channel control method as claimed in claim 11, wherein the step of obtaining the first relative position between the first dock port and the user when detecting that the first single-ear type wireless earphone separates from the first dock port further comprises:

detecting whether the first single-ear type wireless earphone separates from the first dock port, to obtain the first relative position by a detecting circuit of the portable electronic device, wherein the step of providing the one of the left sound channel signal and the right sound channel signal to the first single-ear type wireless earphone according to the first relative position further comprises:

providing the right sound channel signal to the first single-ear type wireless earphone via a wireless module of the portable electronic device when the first relative position represents that the first dock port is located on the right side of the user; and providing the left sound channel signal to the first single-ear type wireless earphone via the wireless module of the portable electronic device when the first relative position represents that the first dock port is located on the left side of the user.

13. The sound channel control method as claimed in claim 12, wherein the detecting circuit obtains the first relative position between the first dock port and the user according to a display picture displayed in a display panel of the portable electronic device by a multimedia application and a second relative position between the display panel and the first dock port.

14. The sound channel control method as claimed in claim 12, wherein the detecting circuit further comprises:

a gravity sensor, a gyroscope, or an electronic compass, obtaining an inclination angle of the portable electronic device, wherein the detecting circuit obtains the first relative position between the first dock port and the user according to the inclination angle.

15. The sound channel control method as claimed in claim 12, wherein the detecting circuit further comprises:

an image capturing device, obtaining a face image of the user, wherein the detecting circuit obtains the first relative position between the first dock port and the user according to the face image.

16. The sound channel control method as claimed in claim 12, wherein when the first single-ear type wireless earphone and the second single-ear type wireless earphone are respectively coupled to the first dock port and the second dock port of the portable electronic device, the wireless module of the portable electronic device enters a sleep mode.

17. The sound channel control method as claimed in claim 11, further comprising:

providing the other of the left sound channel signal and the right sound channel signal to the second single-ear type wireless earphone when detecting that the second single-ear type wireless earphone separates from the second dock port.

18. The sound channel control method as claimed in claim 11, wherein the portable electronic device is a tablet PC.

19. The sound channel control method as claimed in claim 11, further comprising:

detecting whether the second single-ear type wireless earphone separates from the second dock port before detecting that the first single-ear type wireless earphone separates from the first dock port; and providing a stereo signal to the second single-ear type wireless earphone when the second single-ear type wireless earphone separates from the second dock port, wherein the stereo signal comprises the left sound channel signal and the right sound channel signal.

20. The sound channel control method as claimed in claim 19, further comprising:

stopping providing the stereo signal to the second single-ear type wireless earphone, and providing the other of the left sound channel signal and the right sound channel signal to the second single-ear type wireless earphone after the first single-ear type wireless earphone separates from the first dock port.

* * * * *